US010765173B2

(12) United States Patent
Wilson

(10) Patent No.: US 10,765,173 B2
(45) Date of Patent: Sep. 8, 2020

(54) ARTICLE OF FOOTWEAR WITH RECONFIGURABLE FASTENING SYSTEM

(71) Applicant: Under Armour, Inc., Baltimore, MD (US)

(72) Inventor: Reginald Wilson, Baltimore, MD (US)

(73) Assignee: UNDER ARMOUR, INC., Baltimore, MD (US)

( * ) Notice: Subject to any disclaimer, the term of this patent is extended or adjusted under 35 U.S.C. 154(b) by 0 days.

(21) Appl. No.: 15/916,640

(22) Filed: Mar. 9, 2018

(65) Prior Publication Data

US 2018/0255877 A1 Sep. 13, 2018

Related U.S. Application Data

(60) Provisional application No. 62/469,835, filed on Mar. 10, 2017.

(51) Int. Cl.

| | |
|---|---|
| ***A43C 11/00*** | (2006.01) |
| ***A43C 1/00*** | (2006.01) |
| ***A43C 5/00*** | (2006.01) |
| ***A43C 1/04*** | (2006.01) |
| ***A43B 23/02*** | (2006.01) |

(52) U.S. Cl.

CPC ..... *A43C 1/003* (2013.01); *A43B 23/0245* (2013.01); *A43B 23/0265* (2013.01); *A43C 1/04* (2013.01); *A43C 5/00* (2013.01); *A43C 11/00* (2013.01)

(58) Field of Classification Search

CPC ..... A43C 1/003; A43C 1/004; A43C 5/00; A43C 11/00; A43C 1/04; A43B 23/0265; A43B 23/0245; A43B 23/02; A43B 23/00

USPC ..... 36/50.1

See application file for complete search history.

(56) References Cited

U.S. PATENT DOCUMENTS

| | | | | | |
|---|---|---|---|---|---|
| 5,042,120 | A * | 8/1991 | Nichols | A43C 1/04 | 24/713.2 |
| 5,269,078 | A * | 12/1993 | Cochrane | A43B 5/00 | 36/170 |
| 5,291,671 | A * | 3/1994 | Caberlotto | A43B 5/00 | 36/114 |
| 5,408,761 | A * | 4/1995 | Gazzano | A43B 5/00 | 36/102 |
| 6,052,921 | A * | 4/2000 | Oreck | A43C 1/00 | 36/50.1 |

(Continued)

*Primary Examiner* — Timothy K Trieu

(74) *Attorney, Agent, or Firm* — Edell, Shapiro & Finnan, LLC

(57) ABSTRACT

An article of footwear includes a sole, an upper, and a reconfigurable fastening system. The upper is coupled to the sole and includes medial and lateral quarters. Disposed on the medial and lateral quarters are a plurality of eyelets. Each of the eyelets includes a pair of openings disposed in the upper. The plurality of eyelets further includes at least one elongate member threaded through the pair of openings of each eyelet. The elongate member includes a series of first, or unexposed, portions that are disposed on an inner surface of the upper, and a series of second, or exposed, portions that are disposed on the outer surface of the upper. As fastener or lacing may be selectively threaded through an eyelet of the plurality of eyelets, where the fastener may be threaded between the second portion of the elongate member and the outer surface of the upper.

17 Claims, 12 Drawing Sheets

(56) References Cited

U.S. PATENT DOCUMENTS

| | | | | |
|---|---|---|---|---|
| 6,128,835 | A * | 10/2000 | Ritter | A43C 1/00 36/114 |
| 6,286,233 | B1 * | 9/2001 | Gaither | A43C 1/00 36/50.1 |
| 7,343,701 | B2 * | 3/2008 | Pare | A43C 1/06 36/50.1 |
| 10,092,060 | B2 * | 10/2018 | Aveni | A43B 3/122 |
| 10,219,580 | B2 * | 3/2019 | Taylor | A43B 3/0078 |
| 2002/0148142 | A1 * | 10/2002 | Oorei | A43C 1/00 36/129 |
| 2004/0181972 | A1 * | 9/2004 | Csorba | A43C 11/14 36/50.1 |
| 2006/0117607 | A1 * | 6/2006 | Pare | A43C 11/004 36/50.1 |
| 2007/0011910 | A1 * | 1/2007 | Keen | A43B 7/142 36/50.1 |
| 2008/0110048 | A1 * | 5/2008 | Dua | A43B 1/04 36/45 |
| 2009/0071041 | A1 * | 3/2009 | Hooper | A43B 7/06 36/3 A |
| 2013/0019500 | A1 * | 1/2013 | Greene | A43B 23/025 36/50.1 |
| 2014/0196216 | A1 * | 7/2014 | Weitzel | A61G 7/05784 5/691 |
| 2014/0223779 | A1 * | 8/2014 | Elder | A43C 1/04 36/103 |
| 2016/0302524 | A1 * | 10/2016 | Smith | A43C 1/04 |

* cited by examiner

ARTICLE OF FOOTWEAR WITH RECONFIGURABLE FASTENING SYSTEM

CROSS-REFERENCE TO RELATED APPLICATIONS

This application claims priority under 35 U.S.C. 119(e) to U.S. Provisional Patent Application Ser. No. 62/469,835, entitled "Article of Footwear With Reconfigurable Fastening System", filed Mar. 10, 2017, the disclosure of which is incorporated herein by reference in its entirety for all purposes.

FIELD OF THE INVENTION

The present invention relates to an article of footwear that provides an improved and custom fit of an upper around a foot.

BACKGROUND OF THE INVENTION

Footwear, particularly athletic footwear, are worn in a variety of activities including running, walking, hiking, team and individual sports, and any other activity where the protection and support of human feet is desired. In one configuration, an article of footwear includes an upper that forms a cavity in which a user places his or her foot. The article of footwear further includes a sole that engages the bottom of the foot and separates the foot from the ground. Uppers in athletic footwear are usually formed from one or more pieces of fabric, leather, and/or plastic that are stitched, bonded, or otherwise attached together. Various fasteners, including laces or strings, are used to secure the foot in the cavity defined by the upper.

Every human foot differs in both shape and size. While conventional articles of footwear are sold in various sizes, these sizes are generalizations and fail to take into consideration the varying shapes between different feet that have the same size. Because conventional articles of footwear are incapable of accommodating varying shapes of feet, an article of footwear is limited to the number of people that find that article of footwear comfortable.

In addition, while conventional articles of footwear contain eyelets configured to receive a string or laces, the eyelets of the conventional articles of footwear are typically only aligned along the medial and lateral sides of the instep (i.e., proximate to a tongue of an article of footwear). Thus, as a wearer of the conventional article of footwear tightens the laces of the article of footwear, the article of footwear may contain portions that are tighter and more uncomfortable than other portions that are looser. The positioning of the eyelets of the conventional article of footwear inhibit the upper of the article of footwear from contouring and conforming to the shape of the foot within the article of footwear, reducing the comfort of the article of footwear. The positioning of the eyelets also prevents the article of footwear from providing proper support to the foot within the article of footwear, especially during athletic events, such as running.

It would be desirable to provide an article of footwear with a plurality of eyelets disposed over the surface of the upper in a variety of locations, where a lacing element or fastener may be selectively threaded through select eyelets along the upper of an article of footwear in a configuration that is most comfortable to a wearer of the article of footwear. Moreover, it would be desirable to provide the plurality of eyelets to further enable the user of the article of footwear to selectively thread the fastener through select eyelets disposed on the upper of the article of footwear to tightly contour and conform the upper to the shape of any foot placed within the article of footwear, or to alter the amount of support provided by the upper based on an intended activity or event (e.g., running, cross-training, etc.).

SUMMARY OF THE INVENTION

In accordance with example embodiments of the invention, an article of footwear comprises a sole, an upper, and a reconfigurable fastening system. The upper is coupled to the sole and includes medial and lateral quarters. Disposed on the medial and lateral quarters are a plurality of eyelets. Each of the eyelets includes a pair of openings disposed in the upper. The plurality of eyelets further includes at least one elongate member threaded through the pair of openings of each eyelet. The elongate member includes a series of first, or unexposed, portions that are disposed on an inner surface of the upper, and a series of second, or exposed, portions that are disposed on the outer surface of the upper. A fastener or lacing may be selectively threaded through an eyelet of the plurality of eyelets, where the fastener may be threaded between the second portion of the elongate member and the outer surface of the upper.

In accordance with another example embodiment of the invention, an article of footwear includes a sole structure and an upper. The upper is coupled to the sole structure and is configured to receive at least a portion of a human foot. The upper further includes a medial quarter, a lateral quarter, and an elongate member. A plurality of openings are disposed on at least the medial quarter of the upper. The elongate member is threaded through the plurality of openings such that the elongate member includes a series of unexposed portions and exposed portion. The unexposed portions are disposed on an interior surface of the medial quarter. The exposed portions are disposed on an exterior surface of the medial quarter. The exposed portions are configured to enable a fastener to be threaded between the exposed portion and the exterior surface of the medial quarter.

In yet another embodiment of the invention, an article of footwear includes a sole structure and an upper. The upper may be disposed on the sole structure, and may further include a medial side, a lateral side, a plurality of openings, and an elongate member. The plurality of openings may be disposed on the medial side and the lateral side in an array. The elongate member may be threaded through the plurality of openings such that the elongate member includes a series of unexposed portions and a series of exposed portions. The unexposed portions may be disposed on an interior surface of the upper. The exposed portions may be disposed on an exterior surface of the upper. The exposed portions may be configured to enable a fastener to be threaded between the exposed portion and the exterior surface of the upper.

The above and still further features and advantages of embodiments of the present invention will become apparent upon consideration of the following detailed description thereof, particularly when taken in conjunction with the accompanying drawings wherein like reference numerals in the various figures are utilized to designate like components.

BRIEF DESCRIPTION OF THE SEVERAL VIEWS OF THE DRAWING

Like reference numerals have been used to identify like elements throughout this disclosure.

DETAILED DESCRIPTION OF THE INVENTION

Figure 1A:
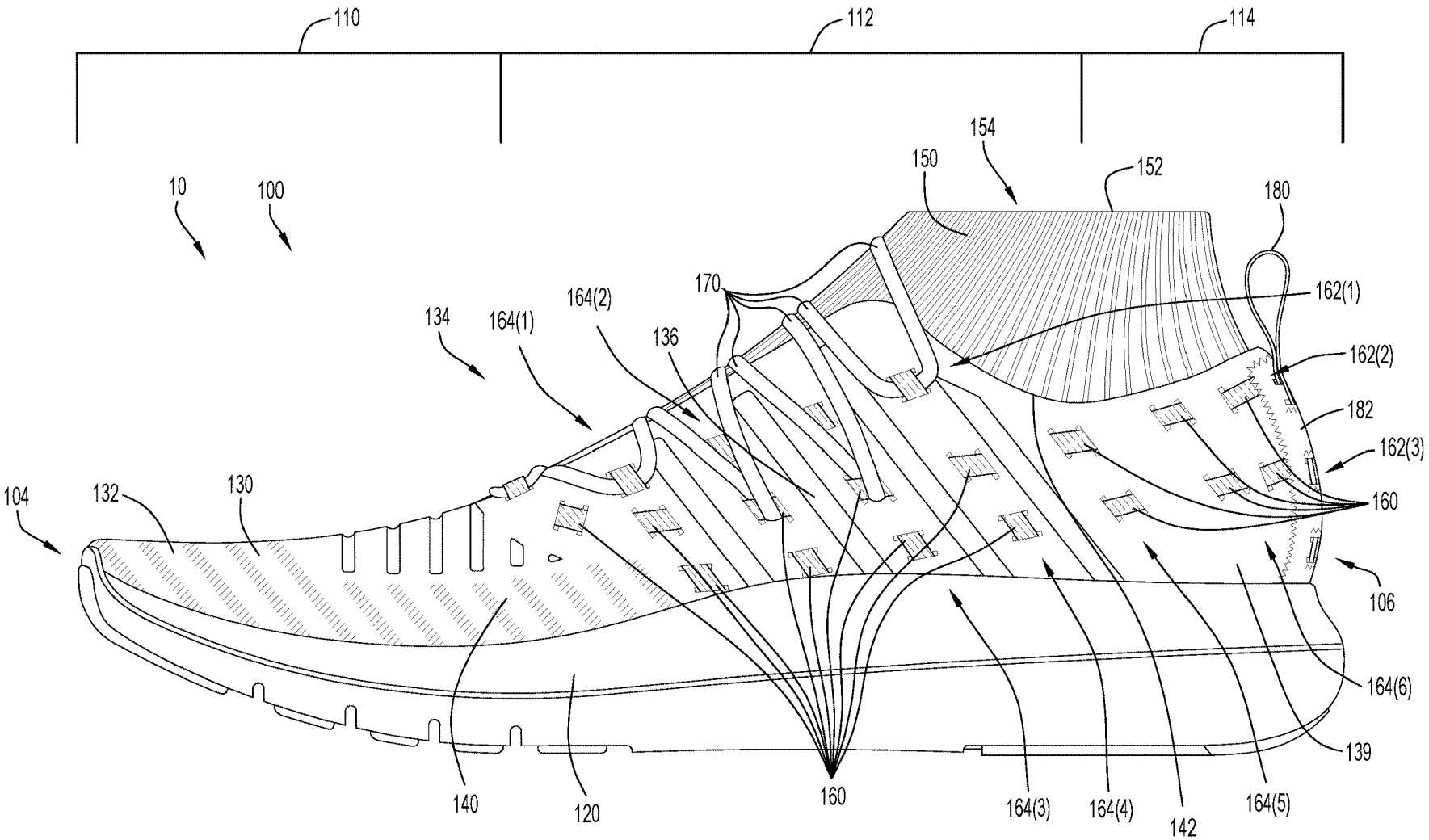
FIG. 1A illustrates a side view in elevation of the medial side of an example embodiment of an article of footwear in accordance with the present invention.

The present invention relates to an article of footwear with a plurality of eyelets disposed over the article of footwear, enabling the user to attach laces of the article of footwear at optimal locations based on the shape of the foot within the article of footwear, comfort of the user, and intended use of the article of footwear.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the description herein. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

An article of footwear or shoe 10 includes a medial side 100 oriented along the medial or big toe side of the user's foot, a lateral side 102 oriented along the lateral or little toe side of the user's foot, a toe (i.e., front) end 104 that corresponds with the toes of the user's foot, and a heel (i.e., rear) end 106 that corresponds with the heel of the user's foot. While the example embodiment depicted in the FIGS. 1A, 1B, 1C, 1D, 2A, 2B, 3A, 3B, and 3C shows an article of footwear 10 configured for a right foot, it is noted that the same or similar features can also be provided for an article of footwear 10 configured for a left foot (where such features of the left footed article of footwear are a reflection of or "mirror image" symmetrical in relation to the right footed article of footwear, e.g., the embodiment depicted in FIGS. 1A, 1B, 1C, 1D, 2A, 2B, 3A, 3B, and 3C).

The article of footwear 10 may include a forefoot region 110 that generally aligns with the ball and toes of a user's foot (i.e., when a user is wearing the article of footwear 10), a midfoot region 112 that generally aligns with the arch and instep areas of the user's foot, and a hindfoot region 114 that generally aligns with the heel and ankle areas of the user's foot. The embodiment of the article of footwear 10 illustrated includes a sole structure 120 and an upper 130 affixed to the sole structure 120. The article of footwear 10, also referred to herein as a shoe, can be in the form of a running shoe or other type of athletic shoe. As is described in further detail herein, the upper 130 includes a first portion 140 and a second portion 150, where a plurality of eyelets 160 are disposed across and within the first portion 140 of the upper 130. The number and placement of the plurality of eyelets 160 enable a user to selectively thread a fastener 170 (e.g., a lace, cord, string, etc.) through certain eyelets 160 to optimize the fit of the article of footwear 10 on the foot. In other words, the number and placement of the eyelets 160 along the upper 120 enable the user of the article of footwear 10 to selectively thread the fastener 170 through the eyelets in any desired manner or design that is best suited for the shape of the foot placed within the article of footwear 10, the comfort of the user of the article of footwear 10, and the intended use of the article of footwear (e.g., running, cross-training, etc.). The user of the article of footwear 10 may alter the support, comfort, and fit provided by the article of footwear 10 by, as described herein, altering the eyelets 160 through which the fastener 170 is threaded.

The upper 130 defines an envelope or pocket that covers and protects the foot of the wearer. In some embodiments, the upper 130 covers and protects the foot of the wearer together with the sole structure 120. The upper 130 includes a toe cage 132 disposed proximate to the front end 104 of the article of footwear 10 in the forefoot region 110 of the article of footwear 10. As further illustrated, the upper 130 also includes an instep 134, where the instep 134 is disposed rearward of the toe cage 132 within the midfoot region 112 of the article of footwear 10. The upper 130 may further include a heel cup 139 disposed in the hindfoot region 114 and around the heel end 106 of the article of footwear 10. In addition, the upper 130 includes a medial quarter 136 that extends through the midfoot region 112 from the toe cage 132 to the heel cup 139 along the medial side 100 of the article of footwear 10 and a lateral quarter 138 that extends through the midfoot region 112 from the toe cage 132 to the heel cup 139 along the lateral side 102 of the article of footwear 10. The toe cage 132 connects the medial quarter 136 to the lateral quarter 138 through the forefoot region 110, while the heel cup 139 connects the medial quarter 136 to the lateral quarter 138 through the hindfoot region 114. Thus, the medial quarter 136 and the lateral quarter 138 are not connected to one another through the instep 130, or midfoot region 112, of the upper 130.

As previously explained, the upper 130 may include a first portion 140 and a second portion 150. Both the first portion 140 and the second portion 150 are formed or constructed from a knit material/fabric (e.g., flat knit, circular knit, etc.) or a woven material/fabric. This enables the upper 130 to be a more flexible, elastic, and/or breathable material than uppers constructed of conventional materials (e.g., leather, suede, plastics, etc.). This also enables the upper 130 of the article of footwear 10 to be lighter than conventional footwear. As best illustrated in FIGS. 1A, 1B, 1C, and 1D, the first portion 140 may form a lower portion of the upper 130, while the second portion 150 may form an upper portion of the upper 130. The first portion 140 may form the toe cage 132, the medial quarter 136, the lateral quarter 138, and the heel cup 139 of the upper 130. The first portion 140 of the upper may form a first, lower collar 142. The second portion 150 of the upper 130 may be disposed within the first portion 140 of the upper 130, or may be disposed adjacent to the lower collar 142. As illustrated, the second portion 150 of the upper 130 may be configured to extend upward from the lower collar 142 of the first portion 140 of the upper 130, such that the second portion defines a second upper collar 152, which defines an aperture 154. The aperture 154 provides access to the interior cavity of the upper 130. The second portion 150 may also be disposed in the instep 134 of the upper 130, where the second portion 150 is disposed between the medial quarter 136 and the lateral quarter 138. While both the first and the second portions 140, 150 may be formed of knit/woven materials, the second portion 150 may be ribbed, resulting in a more resilient and elastic material than the first portion 140.

Figure 1B:
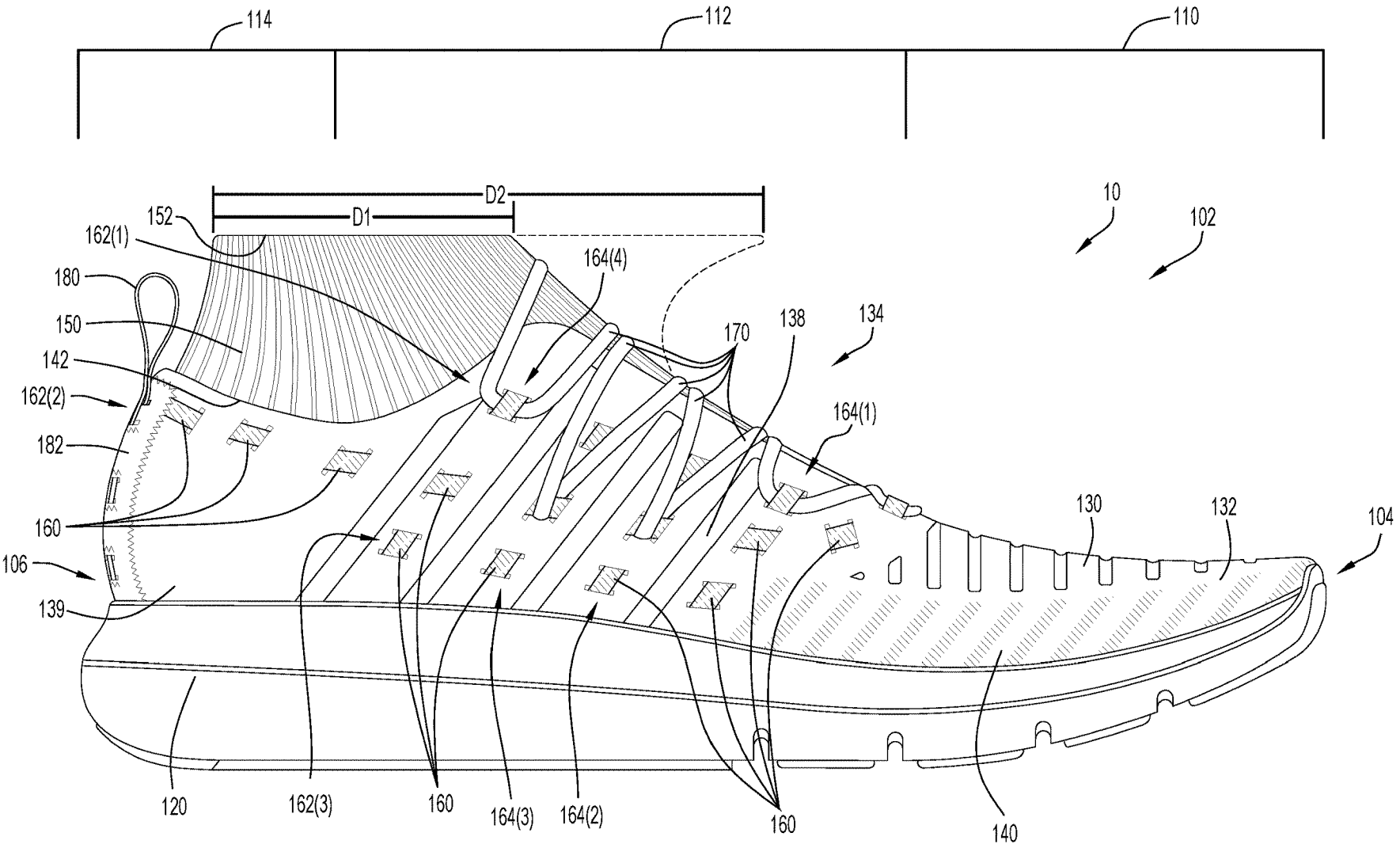
FIG. 1B illustrates a side view in elevation of the lateral side of the example embodiment of the article of footwear illustrated in FIG. 1A.

As best illustrated in FIG. 1B, the upper collar 152 of the second portion 150 may be stretched or expanded between a first, unstretched position (where the aperture 154 has a first diameter D1) and a second stretched position (where the aperture 154 has a second diameter D2). In one embodiment, the diameter D1 of the aperture 154 may be 90 mm, while the fully stretched diameter D2 of the aperture 154 may be 160 mm. The resiliency and stretchability of the second portion 150, and more specifically the upper collar 152, enables the aperture 154 to accommodate a foot being disposed within the upper 130. In addition, the resiliency and stretchability of the upper collar 152 of the second portion 150 of the upper 130 enables the upper collar 152 to accommodate ankles of various sizes and shapes. Because the second portion 150 may be more stretchable and resilient than the first portion 140 of the upper 130, and because the second portion 150 is disposed in the instep 130 between the medial and lateral quarters 136, 138, the second portion 150 enables the medial and lateral quarters 136, 138 to bend or flex outward and away from one another to accommodate both the placement of feet within the article of footwear 10 and the varying widths of feet disposed within the article of footwear 10.

As further detailed below, a plurality of eyelets 160 are disposed on the first portion 140 of the upper 130. The plurality of eyelets 160 are disposed on the portion of the instep 130 proximate to the forefoot region 110, the medial quarter 136, the lateral quarter 138, and on both the medial side 100 and the lateral side 102 of the heel cup 139. Each of the plurality of eyelets 160 is configured to receive a portion of the fastener 170. In other words, the fastener 170 may be threaded through each of the plurality of eyelets 160. Once the fastener 170 is threaded through at least one eyelet 160 on the medial side 100 of the article of footwear and at least one eyelet 160 on the lateral side 102 of the article of footwear 10, the fastener 170 may be pulled to tighten the first and second portions 140, 150 of the upper 130 around the foot disposed within the article of footwear 10.

Figure 1C:
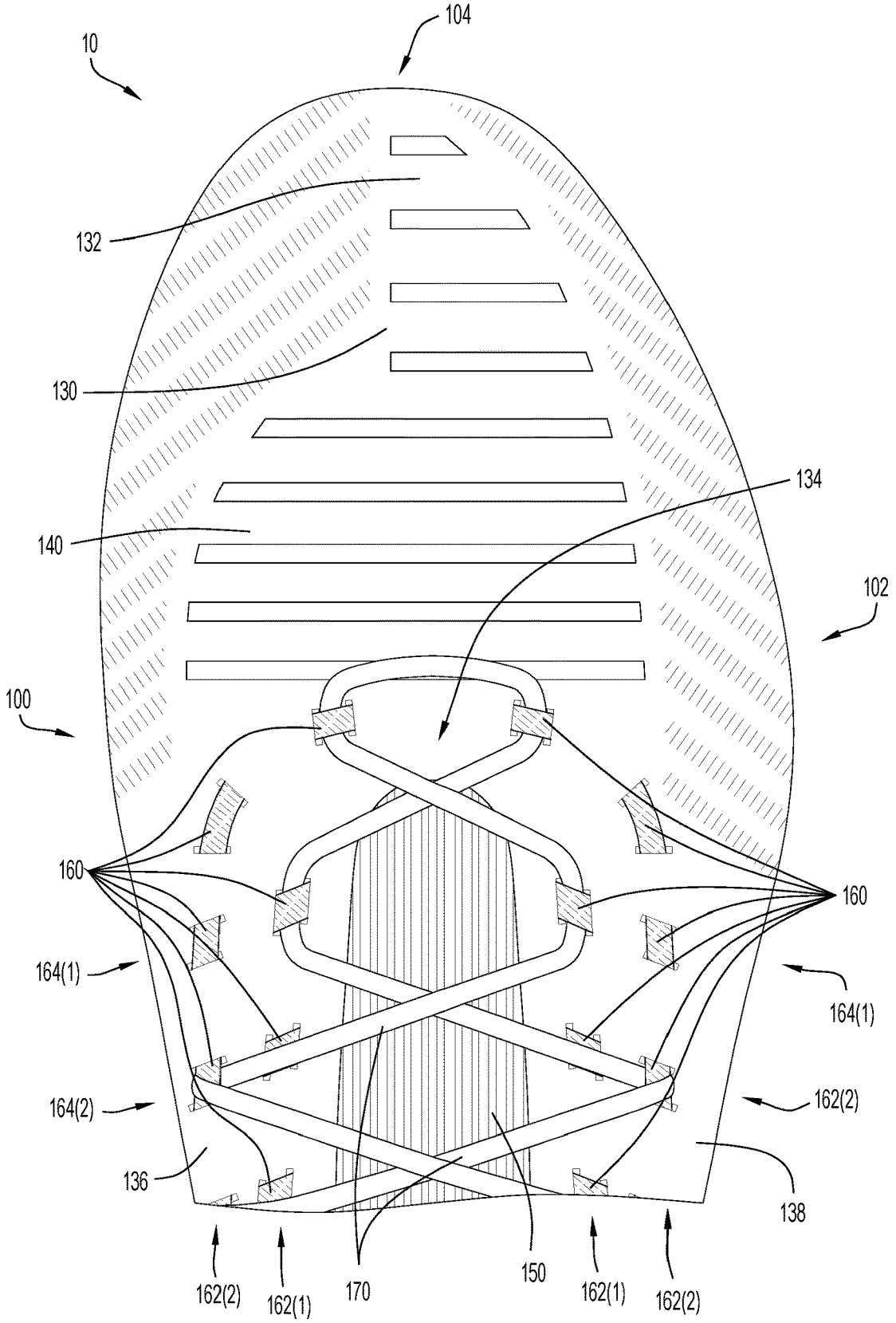
FIG. 1C illustrates a top view of the toe cage and instep of the example embodiment of the article of footwear illustrated in FIG. 1A.
Figure 1D:
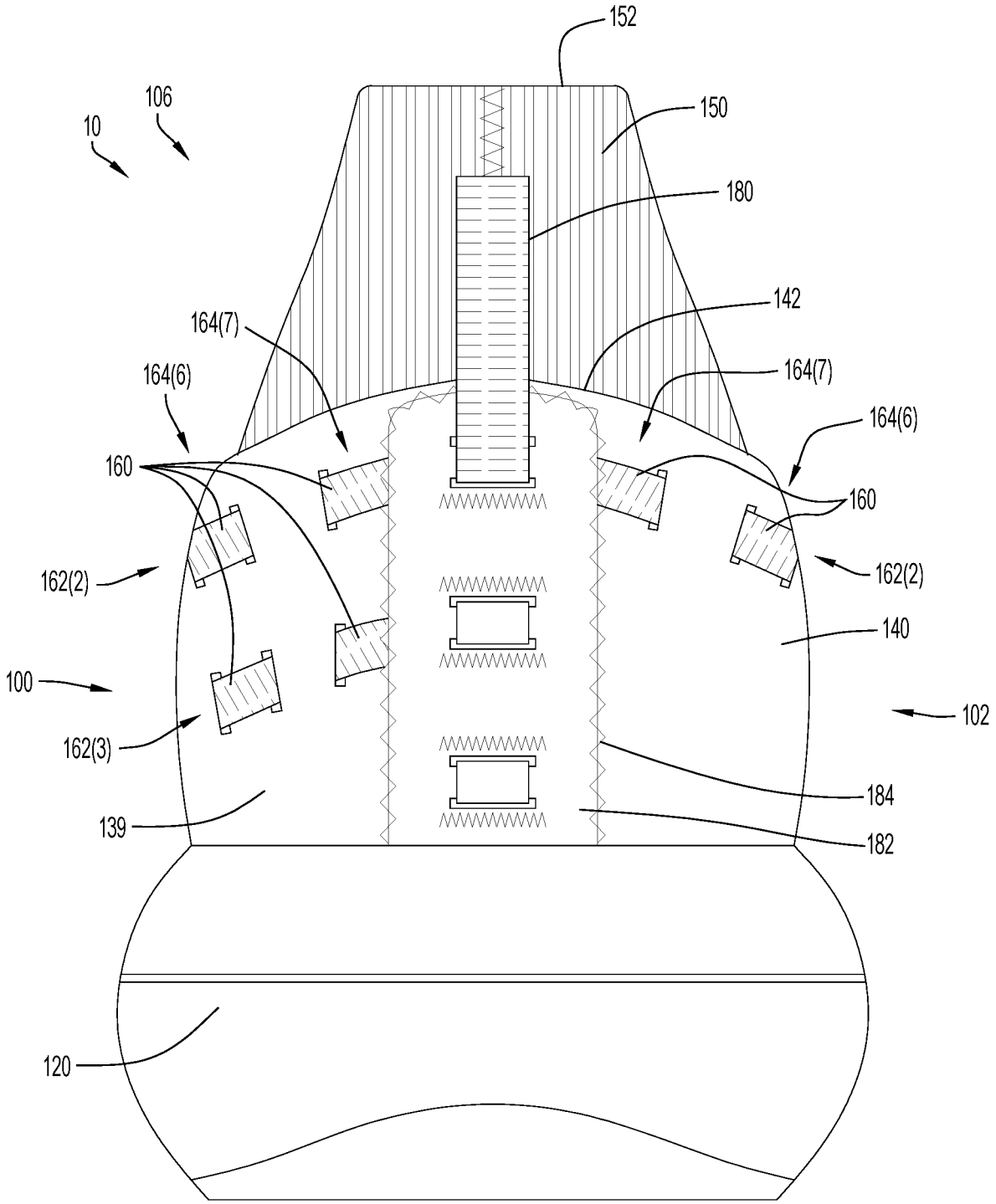
FIG. 1D illustrates a rear view in elevation of the heel end of the example embodiment of the article of footwear illustrated in FIG. 1A.

As further illustrated in FIGS. 1A, 1B, and 1D, a loop/tab 180 is coupled to the first portion 140 of the upper 130 in the hindfoot region 114. The loop 180 is coupled to the heel cup 139 of the first portion 140 of the upper 130 on the heel end 106. The loop 180 may be coupled to the first portion 140 via a reinforcing cover 182 that is coupled to the first portion 140 via a stitching 184. In other embodiments, the reinforcing cover 182 may be coupled to the first portion 140 via any conventional means, including, but not limited to bonding, adhesives, etc. As best illustrated in FIG. 1D, the loop 180 is threaded through the reinforcing cover 182.

The upper 130 may possess any dimensions (size/shape) suitable for its described purpose. For example, the upper 130 may possess a low top configuration in which the upper extends beneath the wearer's ankle, as illustrated in FIGS. 1A, 1B, 1C, and 1D. Alternatively, in other embodiments, the upper 130 may possess a "mid top" configuration (in which the second portion 150 of the upper 130 extends to slightly below or at the wearer's ankle), a "high top" configuration (in which the hindfoot region 206 of the upper extends over and/or above at least a portion of a wearer's ankle), or any other suitable configuration.

Still referring to FIGS. 1A, 1B, 1C, and 1D, the upper 130 is coupled to the sole structure 120 via any conventional and/or other suitable manner (e.g., via any form of adhesion or bonding, via a woven connection, via one or more types of fasteners, etc.). In the particular embodiment depicted, the sole structure 120 may be constructed of a compression material such as ethylene-vinyl acetate (EVA) foam. The compression material is configured to compress on impact and provide cushion to the user's foot as the article of footwear 10 impacts a support surface.

The plurality of eyelets 160 and the fastener 170 form the reconfigurable fastening system of the article of footwear 10. As previously explained, the medial side 100 of the article of footwear 10 includes a plurality of eyelets 160, where the eyelets are disposed primarily within the midfoot region 112 and the hindfoot region 114. As further illustrated, the eyelets 160 on the medial side 100 of the article of footwear 10 are disposed on the medial quarter 136 and the medial side 100 of the heel cup 139. The lateral side 102 of the article of footwear 10 also includes a plurality of eyelets 160, where the eyelets 160 are disposed primarily within the midfoot region 112 and the hindfoot region 114. The eyelets 160 on the lateral side 102 of the article of footwear 10 are disposed on the lateral quarter 138 and the lateral side 102 of the heel cup 139. The portion of the instep 134 proximate to the forefoot region 110 may also include eyelets 160. As illustrated in FIGS. 1A, 1B, 1C, and 1D, the eyelets are disposed on the first portion 140 of the upper 130 in a grid-like array, where the eyelets 160 are aligned to form a series of rows 162(1)-162(3) and columns 164(1)-164(7). As best illustrated in FIG. 1C, the first row 162(1) is disposed on the medial quarter 136 and the lateral quarter 138 such that the first row 162(1) extends only through the midfoot region 112. Conversely, the second row 162(2) extends from the medial side 100 of the heel cup 139, through the medial quarter 136, around the front end of the instep 130 (proximate to the forefoot region 110), through the lateral quarter 138 and through the heel cup 139 such that the second row 162(2) terminates on the lateral side 102 of the heel cup 139. The third row 162(3) of eyelets 160 on the medial side 100 extends from the heel cup 139 and the hindfoot region 114, through the medial quarter 136 and the midfoot region 112. The third row 162(3) of eyelets 160 on the lateral side 102, however, may only extend along the lateral quarter 138 and in the midfoot region 112.

It should further be understood that the eyelets 160 need not be aligned in a series of rows 162(1)-162(3) and columns 164(1)-164(7), and may be oriented on the first portion 140 of the upper 130 in other orientations. In addition, it should also be understood that the eyelets 160 may be located in other regions (i.e., forefoot region 110) of the upper 130, and on other portions (i.e., second portion 150) and components of the upper 130.

Figure 2A:
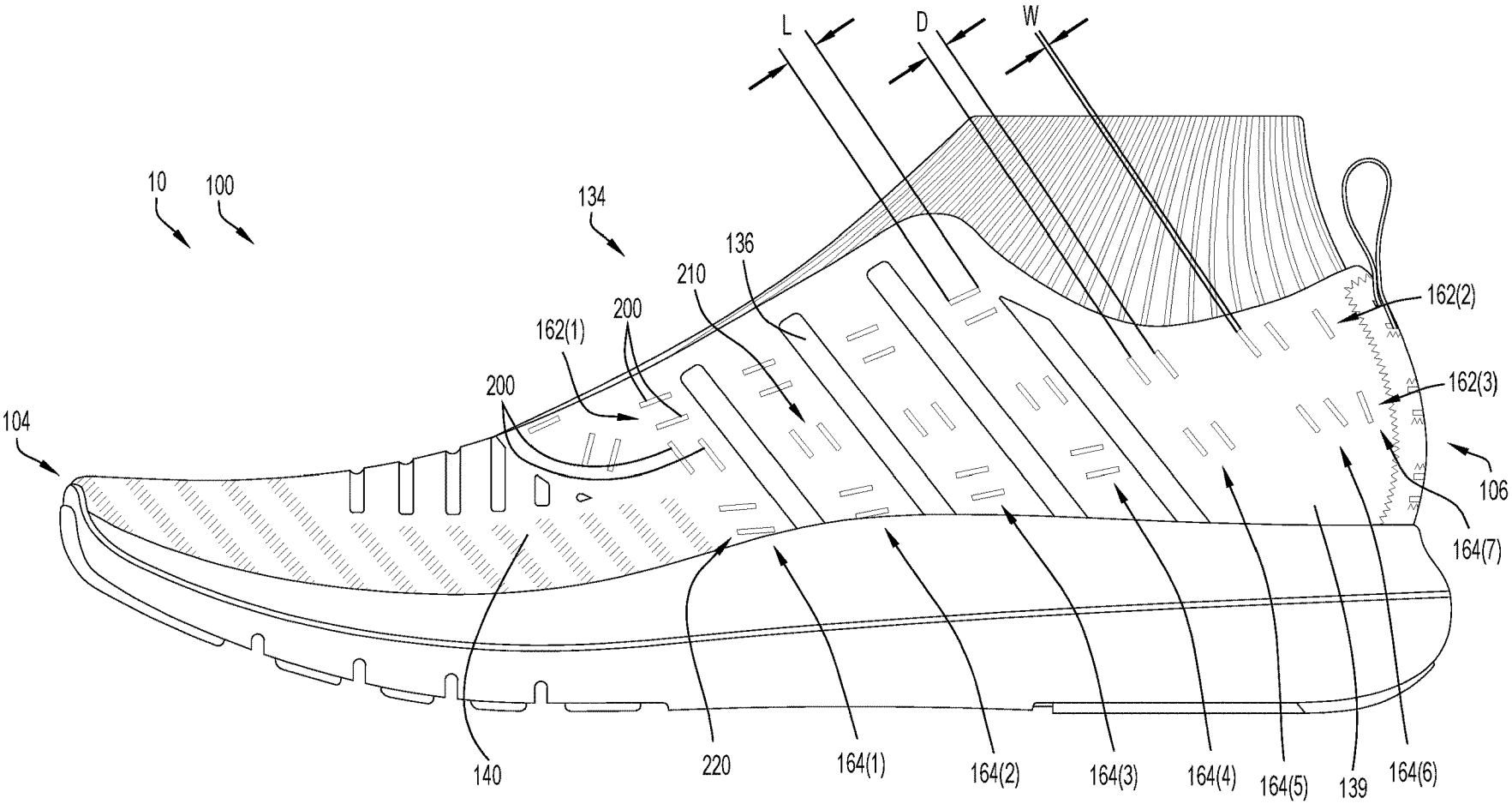
FIG. 2A illustrates a side view in elevation of the medial side of the example embodiment of the article of footwear illustrated in FIG. 1A, the side view showing the slits of the eyelets on the medial side of the upper of the article of footwear.
Figure 2B:
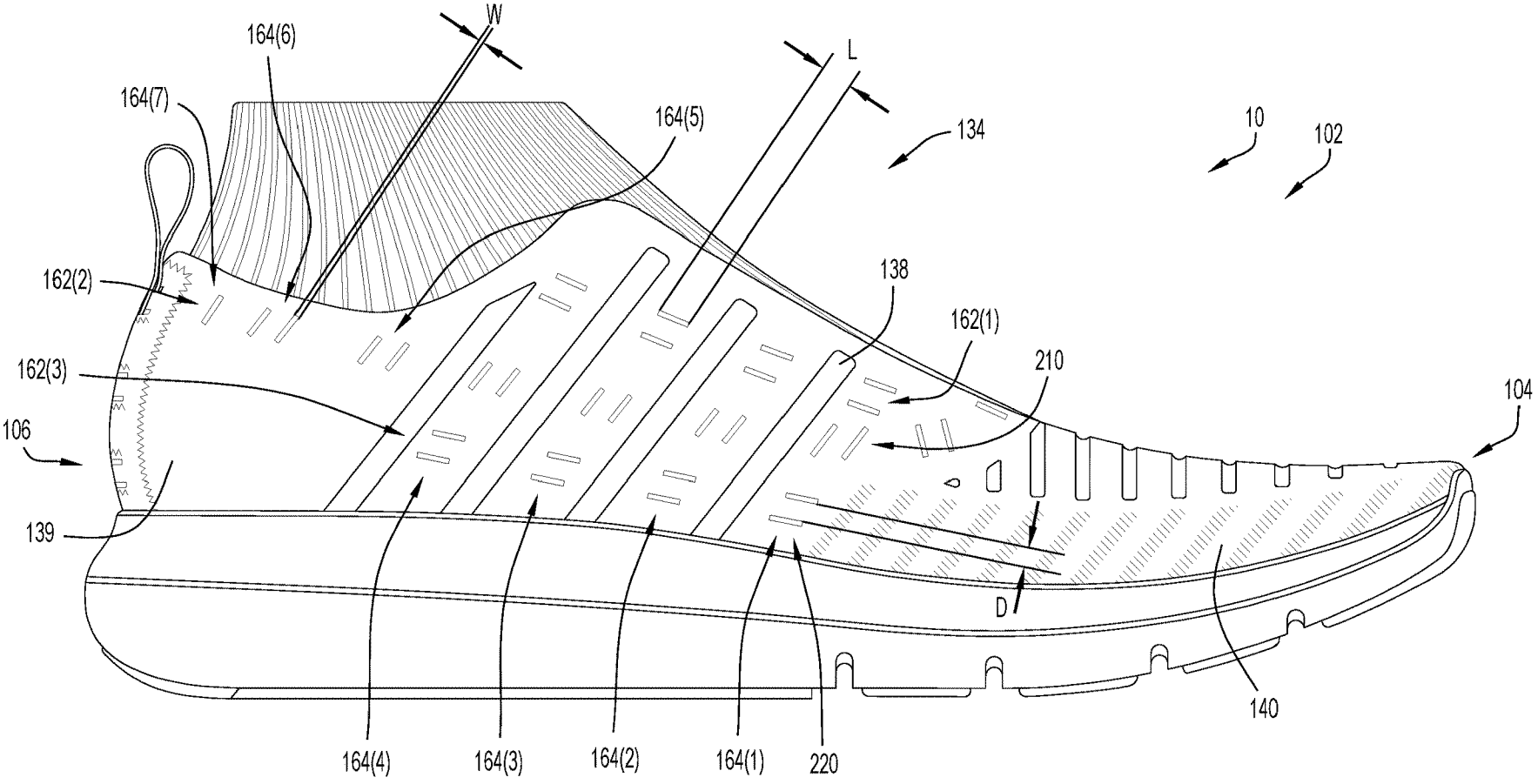
FIG. 2B illustrates a side view in elevation of the lateral side of the example embodiment of the article of footwear illustrated in FIG. 1A, the side view showing the slits of the eyelets on the lateral side of the upper of the article of footwear.

As best illustrated in FIGS. 2A, 2B, 3A, 3B, and 3C, each eyelet 160 is constructed from a pair of slits/openings 200 formed in the first portion 140 of the upper 130 and a portion of one of elongate members (e.g., cord, band, string, strand, lace, etc.) 300, 310, 320, 330 being threaded through the pairs of slits 200 such that the portion of the elongate members 300, 310, 320, 330 are exposed on the outer surface of the first portion 140 of the upper 130. As best illustrated in FIGS. 2A and 2B, each slit 200 has a width W and a length or height L. Each of the slits 200 of a pair may be spaced from one another by a distance D. In the example embodiment illustrated, each slit 200 of each eyelet 160 has a width W of approximately 2 mm, a length L of approximately 8 mm, and the slits 200 of a pair may be spaced by a distance D of approximately 6 mm. In other embodiments, the slits 200 of the eyelets 160 may be of any other width W and length L, and may be spaced from another slit in a pair by any other distance D, that enables the slits 200 of each eyelet 160 to receive a portion of one of the elongate members 300, 310, 320, 330.

Continuing with FIGS. 2A and 2B, the eyelets 160 of the second row 162(2) of eyelets 160, which is disposed on both the medial and lateral sides 100, 102, and across the instep 130, include slits 200 that are mainly oriented in a first orientation 210 (except for the slits 200 that form the two eyelets 160 disposed on the instep 130 of the article of footwear 10). The majority of the eyelets 160 that form the first and third rows 162(1), 162(3) on both the medial and lateral sides 100, 102 of the first portion 140 of the article of footwear 10 contain slits 200 that are oriented in a second orientation 220. The slits 200 of the eyelets 160 in columns 164(5)-164(7) on the medial side 100, however, are oriented in the first orientation 210. The slits 200 of the eyelets 160 in row 162(2) that are disposed in the instep 130 of the article of footwear 10 (i.e., not on the medial or lateral quarters 136, 138) are oriented in the second orientation 220. The slits 200 of the eyelets 160 that are oriented in the first orientation 210 such that the length L of the slits 200 extends predominately along the transverse or widthwise direction of the article of footwear 10 (i.e., the slits 200 are oriented such that they extend in the direction that crosses the article of footwear 10 from the medial side 100 to the lateral side 102, or vice versa). The slits 200 of the eyelets 160 that are oriented in the second orientation 220 such that the length L of the slits 200 extends predominantly in the lengthwise direction of the article of footwear 10 (i.e., the slits 200 are oriented such that they extend along the length, from the heel end 106 to the toe end 104, of the article of footwear 10).

Figure 3A:
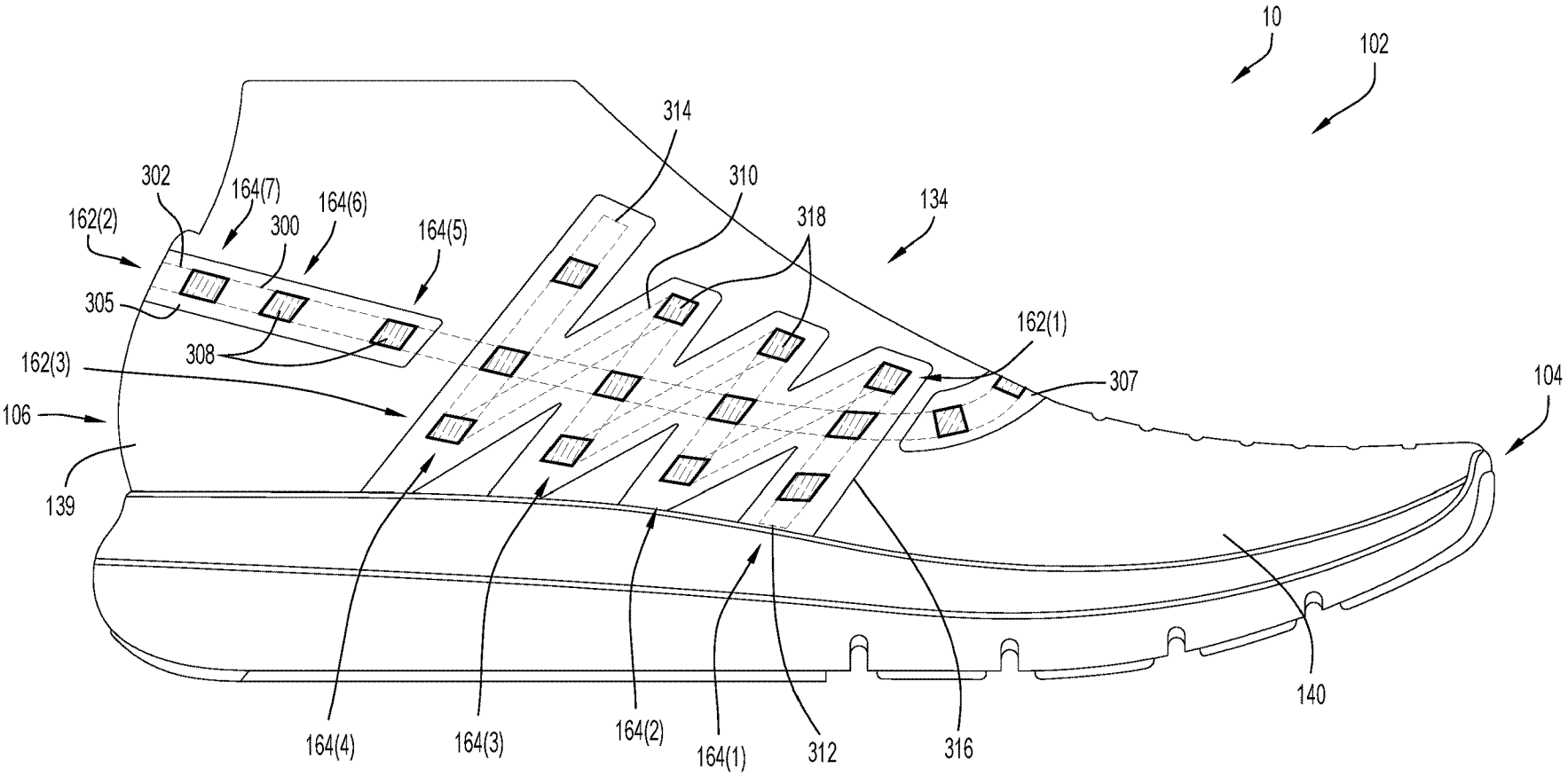
FIG. 3A illustrates a side view in elevation of the lateral side of the example embodiment of the article of footwear illustrated in FIG. 1A, the side view showing the positioning of the elongate members of the eyelets on the lateral side of the article of footwear.
Figure 3B:
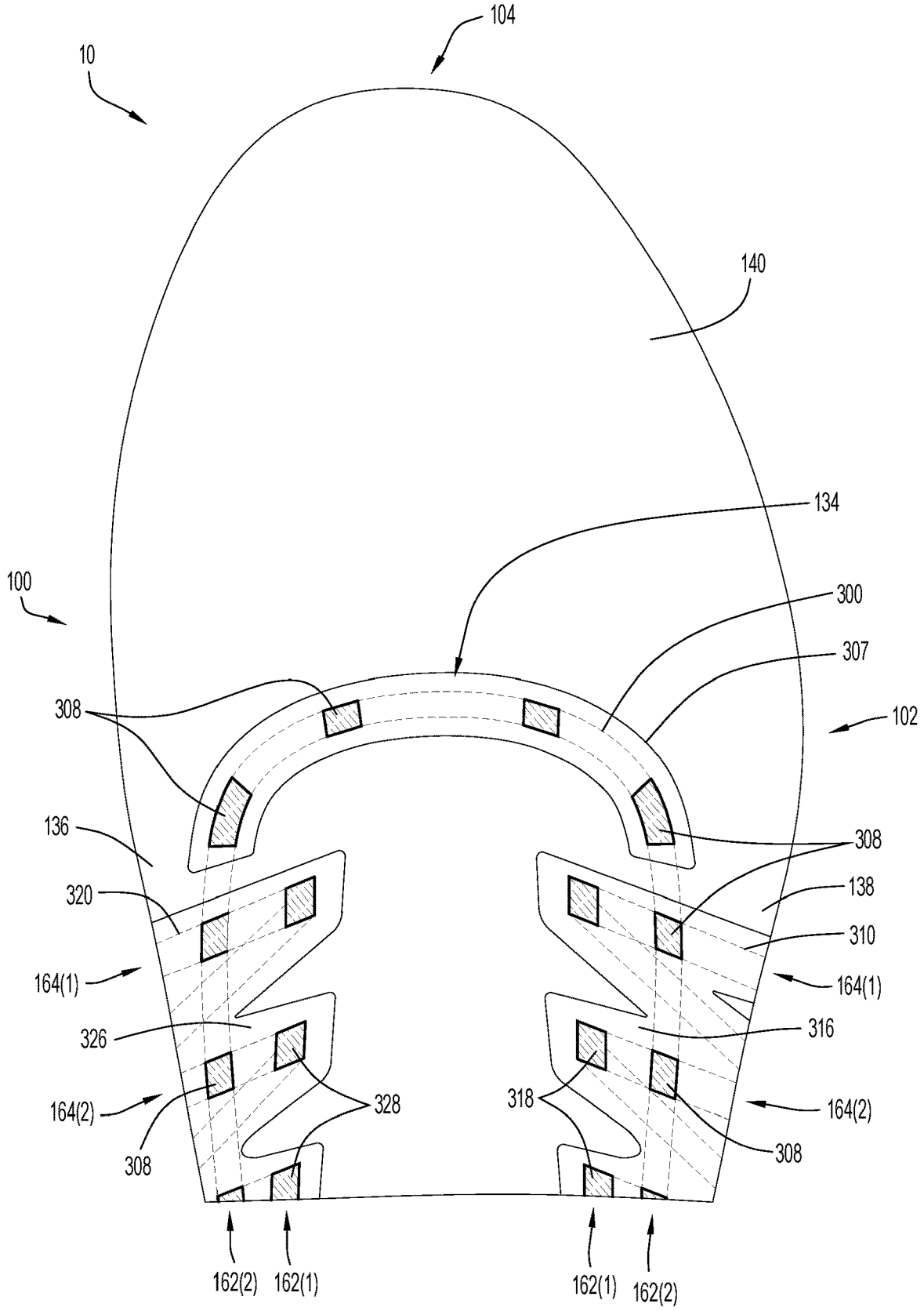
FIG. 3B illustrates a top view of the toe cage and instep of the example embodiment of the article of footwear illustrated in FIG. 1A, the top view showing the positioning of the elongate members of the eyelets in the forefoot and midfoot sections of the article of footwear.
Figure 3C:
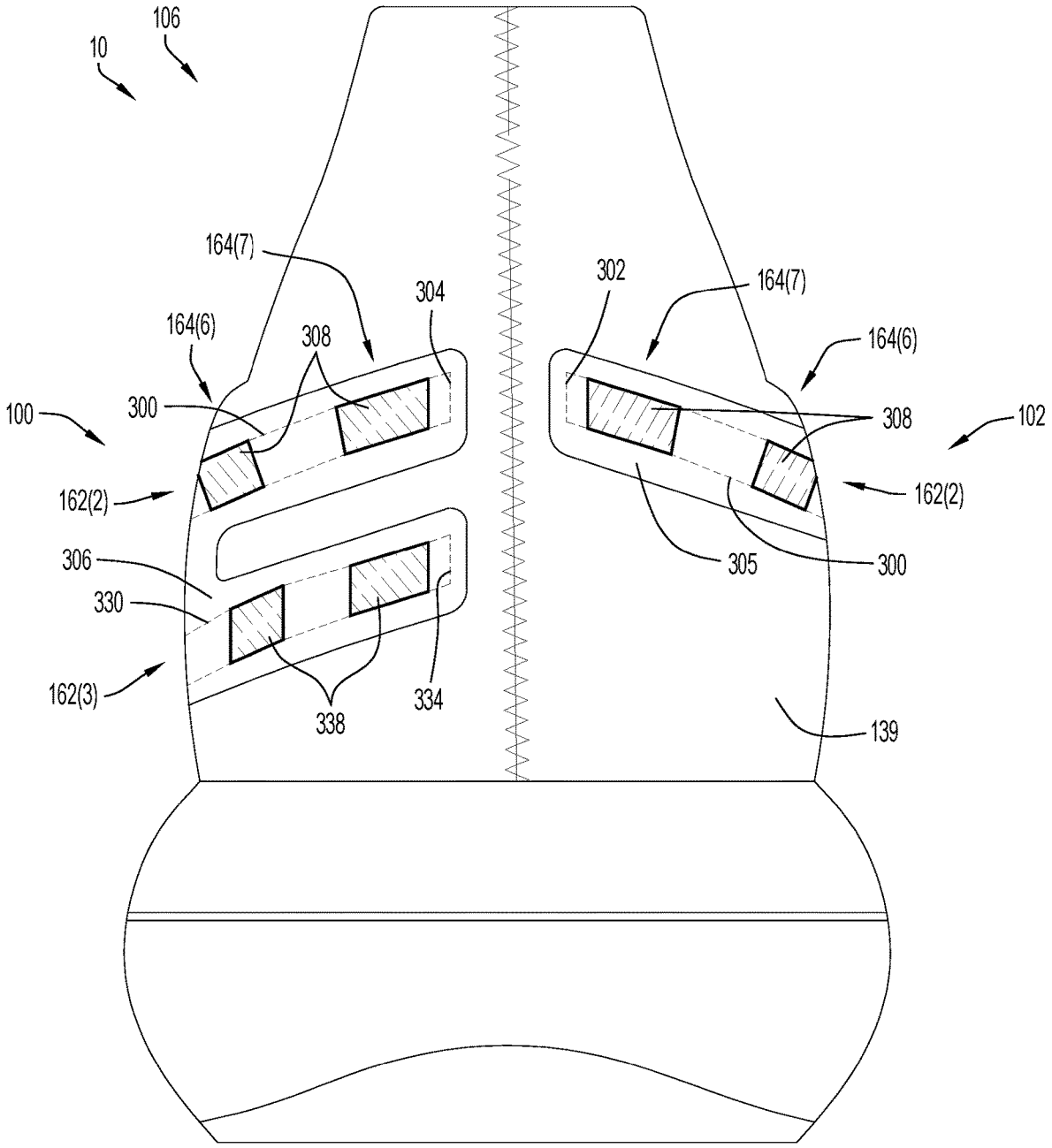
FIG. 3C illustrates a rear view in elevation of the heel end of the example embodiment of the article of footwear illustrated in FIG. 1A, the rear view showing the positioning of the elongate members of the eyelets on both the medial and lateral sides in the hindfoot section of the article of footwear.

As previously stated, and as illustrated in FIGS. 3A, 3B, and 3C, the eyelets 160 of the reconfigurable fastening system of the article of footwear 10 includes elongate members 300, 310, 320, 330 that are threaded through the slits 200 of each eyelet 160. The elongate members 300, 310, 320, 330 are flexible, possessing tensile strength sufficient for their described purpose (to capture a fastener 170 (e.g., lace) and secure a shoe to a user's foot). As previously explained, the elongate members 300, 310, 320, 330 may be in the form of a cord, a band, a string, a lace, or a strand, such that the elongate members 300, 310, 320, 330 can be formed from a single fiber, filament, or monofilament, as well as an ordered assemblage of textile fibers having a high ratio of length to diameter and normally used as a unit (e.g., slivers, roving, single yarns, plies yarns, cords, braids, ropes, etc.). In an example embodiment, an elongate member comprises one or more yarns (a continuous strand of textile fibers, filaments, or material in a form suitable for knitting, weaving, or otherwise intertwining to form a textile fabric). A yarn may include, but is not limited to, a number of fibers twisted together (spun yarn), a number of filaments laid together without twist (a zero-twist yarn), a number of filaments laid together with a degree of twist, and a single filament with or without twist (a monofilament). In another example, the elongate members 300, 310, 320, 330 can comprise a nylon cord, a polyester cord, or a cord formed of high molecular weight polyolefin (e.g., polyethylene). In still other embodiments, the elongate members 300, 310, 320, 330 can comprise a metal wire or cable. The elongate members 300, 310, 320, 330 may further include multiple lines, cables, or cords. In yet another embodiment, the elongate members 300, 310, 320, 330 may be constructed to be resilient and contain a degree of stretchability.

The first elongate member 300 contains a first end 302 and a second end 304, where the first and second ends 302, 304 of the first elongate member 300 are disposed proximate to one another on the heel end 106 of the article of footwear 10 such that the first end 302 is disposed on the lateral side 102 of the heel end 106 of the article of footwear 10 and the second end 304 is disposed on the medial side 100 of the heel end 106 of the article of footwear 10. As further described herein, at least the first and second ends 302, 304 of the first elongate member 300 are fastened to the interior surface of the upper 130. The first elongate member 300 extends from the first end 302 through the lateral side 102 of the heel cup 139, through the lateral quarter 138, around the front end of the instep 130, through the medial quarter 136, and through the medial side 100 of the heel cup 139 to the second end 304. Thus, the first elongate member 300 extends around the first portion 140 of the upper 130.

The first elongate member 300 is aligned with the second row 162(2) of the eyelets 160, and is configured to be threaded through the slits 200 that are aligned with the second row 162(2) of the eyelets 160. Thus, the first elongate member 300 is primarily threaded through the slits 200 that are in the first orientation 210. With the slits 200 of the eyelets 160 of the second row 162(2) of eyelets 160 on the medial and lateral sides 100, 102 in the first orientation 210 and the slits 200 of the eyelets 160 of the second row 162(2) of eyelets 160 on the instep 134 be in the second orientation 220, the first elongate member 300 is able to span or loop around the first portion 140 of the upper 130 from the lateral side 102 proximate to the heel end 106, over the instep 134, and to the medial side 100 proximate to the heel end 106. The first elongate member 300 is primarily disposed on the interior surface of the first portion 140 of the upper 130, except for the exposed portions 308, which are disposed between pairs of slits 200 that form each eyelet 160 of the second row 162(2) of the eyelets 160. The exposed portions 308 of the first elongate member 300 are disposed on the outer surface of the first portion 140 of the upper 130, enabling a fastener 170 to be threaded between the exposed portion 308 of the first elongate member 300 and the outer surface of the first portion 140 of the upper 130 (as illustrated in FIGS. 1A, 1B, 1C, and 1D).

The second and third elongate members 310, 320 are substantially similar to one another, in that the second and third elongate members 310, 320 are oriented in a sawtooth wave (e.g., zig-zag) pattern on the first portion 140 of the upper 130. As illustrated in FIGS. 3A and 3B, the second elongate member 310 is primarily disposed on the lateral quarter 138. The second elongate member 310 includes a first end 312 and a second end 314, and extends across/over the portion of the first elongate member 300 disposed on the lateral quarter 138 in a sawtooth wave pattern. As further described herein, at least the first and second ends 312, 314 of the second elongate member 310 are fastened to the interior surface of the lateral quarter 138 of the upper 130. The second elongate member 310 is utilized to form the eyelets 160 located in the first row 162(1) and the third row 162(3) of columns 164(1)-164(4) of eyelets 160 on the lateral side 102 of the first portion 140 of the upper 130. Thus, the second elongate member 310 is only threaded through slits 200 that are in the second orientation 220. With the slits 200 of the eyelets 160 that are located in the first and the third rows 162(1), 162(3) and the columns 164(1)-164(4) on the lateral side 102 being oriented in the second orientation 220, the second elongate member 310 is able to have a sawtooth wave pattern on the lateral side 102 of the upper 130. The second elongate member 310 is primarily disposed on the interior surface of the first portion 140 of the upper 130, except for the exposed portions 318, which are disposed between each pair of slits 200 that form each eyelet 160 of the first and the third rows 162(1), 162(3) of columns 164(1)-164(4) of the eyelets 160 on the lateral side 102 of the upper 130. The exposed portions 318 of the second elongate member 310 are disposed on the outer surface of the first portion 140 of the upper 130, enabling a fastener 170 to be threaded between the exposed portion 318 of the second elongate member 310 and the outer surface of the first portion 140 of the upper 130 (as illustrated in FIGS. 1B and 1C).

While FIG. 3B only partially illustrates the third elongate member 320, the third elongate member 320 is substantially similar to the second elongate member 310, except that the third elongate member 320 is disposed on the medial side 100 of first portion 140 of the upper 130. More specifically, the third elongate member 320 is disposed on the medial quarter 136 of the first portion 140 of the upper 130. While not illustrated, the third elongate member 320 includes a first end 322 and a second end 324, where at least the first and second ends 322, 324 of the third elongate member 320 are fastened to the interior surface of the medial quarter 136 of the upper 130. FIG. 3B illustrates, however, that the third elongate member 320 extends across/over the portion of the first elongate member 310 disposed on the medial quarter 136 in a sawtooth wave pattern. The third elongate member 320 is utilized to form the eyelets 160 located in the first row 162(1) and the third row 162(3) of columns 164(1)-164(4) of the eyelets 160 on the medial side 100 of the first portion 140 of the upper 130. Thus, similar to the second elongate member 310, the third elongate member 320 is only threaded through slits 200 that are in the second orientation 220. With the slits 200 of the eyelets 160 that are located in the first and the third rows 162(1), 162(3) and the columns 164(1)-164(4) on the medial side 100 being oriented in the second orientation 220, the third elongate member 320 is able to have a sawtooth wave pattern on the medial side 100 of the upper 130. The third elongate member 320 is primarily disposed on the interior surface of the first portion 140 of the upper 130, except for the exposed portions 328, which are disposed between each pair of slits 200 that form the eyelets 160 of the first and the third rows 162(1), 162(3) of columns 164(1)-164(4) of the eyelets 160 on the medial side 100 of the upper 130. The exposed portions 328 of the third elongate member 320 are disposed on the outer surface of the first portion 140 of the upper 130, enabling a fastener 170 to be threaded between the exposed portion 328 of the third elongate member 320 and the outer surface of the first portion 140 of the upper 130 (as illustrated in FIGS. 1A and 1C).

The article of footwear 10 also includes a fourth elongate member 330 disposed on the medial side 100 of the first portion 140 of the article of footwear 10. While the fourth elongate member 330 is only partially illustrated in FIG. 3C, the fourth elongate member 330 includes a first end 332 and a second end 334. The first end 332 of the fourth elongate member 330, while not illustrated, may be disposed on the medial side 100 of the first portion 140 of the article of footwear 10 within, or proximate to, the medial quarter 136. The second end 334 of the fourth elongate member 330, as best illustrated in FIG. 3C, is disposed on the medial side 100 of the heel cup 139 proximate to the heel end 106. As further described herein, at least the first and second ends 332, 334 of the fourth elongate member 330 are fastened to the interior surface of the upper 130. As further illustrated in FIG. 3C, the fourth elongate member 330 may be disposed lower in height on the medial side 100 of the first portion 140 of the upper 130 than the first elongate member 300.

The fourth elongate member 330 is aligned with the third row 162(3) of the eyelets 160 on the medial side 100 of the upper 130, and is configured to be threaded through the slits 200 of the eyelets 160 that are aligned with the third row 162(3) of the eyelets 160. Because the third elongate member 320 is utilized to form the eyelets 160 located in the third row 162(3) of columns 164(1)-164(4) of eyelets 160 on the medial side 100 of the first portion 140 of the upper 130, the fourth elongate member 330 may only be utilized to form the eyelets 160 located in the third row 162(3) of columns 164(5)-164(7) of the eyelets 160 on the medial side 100 of the first portion 140 of the upper 130. Furthermore, the eyelets 160 located in the third row 162(3) of columns 164(5)-164(7) may contain slits 200 of that are in the first orientation 210. Thus, the fourth elongate member 330 is primarily threaded through the slits 200 that are in the first orientation 210. Similar to the other elongate members 300, 310, 320, the fourth elongate member 330 is primarily disposed on the interior surface of the first portion 140 of the upper 130, except for the exposed portions 338, which are disposed between each pair of slits 200 that form each eyelet 160 of the third row 162(3) of columns 164(5)-164(7) of eyelets 160. The exposed portions 338 of the fourth elongate member 330 are disposed on the outer surface of the first portion 140 of the upper 130, enabling a fastener 170 to be threaded between the exposed portion 338 of the fourth elongate member 330 and the outer surface of the first portion 140 of the upper 130 (as illustrated in FIGS. 1A and 1D).

FIGS. 3A, 3B, and 3C further illustrate that the elongate members 300, 310, 320, 330 are secured to the interior surface of the first portion 140 of the upper 130 by a series of panels 305, 306, 307, 316, and 326 that are coupled to the interior surface of the first portion of the upper 130. The panels 305, 306, 307, 316, and 326 may be coupled to the interior surface of the first portion 140 of the upper 130 via any conventional means, including, but not limited to, stitching, bonding, adhesives, etc. Panel 305 is positioned behind the first elongate member 300 in columns 164(5)-164(7) of the second row 162(2) of eyelets 160 on the lateral side 102 of the upper 130 to secure the first elongate member 300 to the interior surface of the lateral side 102 of first portion 140 of the upper 130 at this location. Similarly, panel 306 is positioned behind the first elongate member 300 and the fourth elongate member 330 in columns 164(5)-164(7) of the second row 162(2) of eyelets 160 on the medial side 100 of the upper 130 to secure both the first elongate member 300 and the fourth elongate member 330 to the interior surface of the medial side 100 of first portion 140 of the upper 130 at this location. As best illustrated in FIG. 3B, panel 307 is positioned behind the portion of the first elongate member 300 that traverse the instep 134 proximate to the forefoot region 110 of the article of footwear 100. Thus, panel 307 extends across the instep 134 from the medial quarter 136 to the lateral quarter 138 to secure the first elongate member 300 to the interior surface of the first portion 140 of the upper 130 at this location. As described and illustrated, the first and fourth elongate members 300, 330 are secured to the interior surface of the upper 130 in relation to the panels 305, 306, 307 and the interior surface of the upper 130 that generally prevents or limits movement of the first and fourth elongate members 300, 330 with respect to the panels 305, 306, 307 and the interior surface of the upper 130.

Panels 316 and 326 may differ in shape from panels 305, 306, 307. As illustrated in FIGS. 3A and 3B, the panels 316, 326 may have a sawtooth wave pattern or shaped like that of the second and third elongate members 310, 320, respectively. Panel 316 may be positioned behind both the first elongate member 300 and the second elongate member 310 in the columns 164(1)-164(4) of the rows 162(1)-162(3) of the eyelets 160 on the lateral side 102 of the upper 130. As illustrated, panel 316 extends along the first column 164(1) from the third row 162(3) of eyelets 160 to the first row 162(1) of eyelets 160, where panel 316 then extends diagonally from the eyelet 160 at row 162(1) and column 164(1) to the eyelet 160 at row 162(3) and column 164(2). Panel 316 may continue to extend along the second column 164(2) from the third row 162(3) of the eyelets 160 to the first row 162(1) of eyelets, where panel 316 then extends diagonally from the eyelet 160 at row 162(1) and column 164(2) to the eyelet 160 at row 162(3) and column 164(3). The panel 316 further continues to extend along the third column 164(3) from the third row 162(3) of the eyelets 160 to the first row 162(1) of eyelets 160, then extend diagonally from the eyelet 160 at row 162(1) and column 164(3) to the eyelet 160 at row 162(3) and column 164(4), and finally extend along the fourth column 164(4) from the third row 162(3) of eyelets 160 to the first row 162(1) of eyelets 160. Because the second elongate member 310 extends across/over, in a sawtooth wave pattern, the portion of the first elongate member 300 disposed on the lateral quarter 138, the panel 316 may secure both the first elongate member 300 and the second elongate member 310 to the interior surface of the lateral side 102 of first portion 140 of the upper 130 at the lateral quarter 138. As described and illustrated, the first and second elongate members 300, 310 are secured to the interior surface of the upper 130 in relation to panel 316 and the interior surface of the upper 130 that generally prevents or limits movement of the first and second elongate members 300, 310 with respect to panel 316 and the interior surface of the upper 130.

Panel 326 may be positioned behind both the first elongate member 300 and the third elongate member 320 in the columns 164(1)-164(4) of the rows 162(1)-162(3) of eyelets 160 on the medial side 100 of the upper 130. Panel 326 is disposed columns 164(1)-164(4) and rows 162(1)-162(3) in a sawtooth wave pattern similar to that of panel 316, such that panel 316 starts at the eyelet 160 of row 162(3) and column 164(1) and ends at the eyelet 160 of row 162(1) and column 164(4). Because the third elongate member 310 extends across/over, in a sawtooth wave pattern, the portion of the first elongate member 300 disposed on the medial quarter 136, the panel 326 may secure both the first elongate member 300 and the third elongate member 320 to the interior surface of the medial side 100 of first portion 140 of the upper 130 at the medial quarter 136. As described and illustrated, the first and third elongate members 300, 320 are secured to the interior surface of the upper 130 in relation to panel 326 and the interior surface of the upper 130 that generally prevents or limits movement of the first and third elongate members 300, 320 with respect to panel 316 and the interior surface of the upper 130.

In another embodiment, the panels 305, 306, 307, 316, 326 illustrated in FIGS. 3A, 3B, and 3C may only secure the ends 302, 304 of the first elongate member 300, the ends 312, 314 of the second elongate member 310, the ends 322, 324 of the third elongate member 320, and the ends 332, 334 of the fourth elongate member 340 to the interior surface of the upper 130. Thus, when the elongate members 300, 310, 320, 330 are secured at only their ends 302, 304, 312, 314, 322, 324, 332, 334, the elongate members 300, 310, 320, 330 may be configured to at least partially move with respect to the upper 130. In this embodiment, the elongate members 300, 310, 320, 330 may also be capable of at least partially moving, threading, or passing through the slits 200. The passage or threading of the elongate members 300, 310, 320, 330 through the slits 200 also maintains the elongate members 300, 310, 320, 330 in their position against the upper 130. In yet another embodiment, the elongate members 300, 310, 320, 330 may be secured between the panels 305, 306, 307, 316, 326 and the interior surface of the upper 130 at the ends 302, 304, 312, 314, 322, 324, 332, 334 of the elongate members 300, 310, 320, 330 and/or at select portions of each of the elongate members 300, 310, 320, 330 between the ends 302, 304, 312, 314, 322, 324, 332, 334 of the elongate members 300, 310, 320, 330.

The panels 305, 306, 307, 316, 326 not only serve to secure the elongate members 300, 310, 320, 330 to the interior surface of the first portion 140 of the upper 130, but they also server to make the upper 130 more comfortable for a user. By covering the portions of the elongate members 300, 310, 320, 330 on the interior surface of the first portion 140, the interior surface will have a smoother, more comfortable feel to a foot disposed within the article of footwear 10. The panels 326 also help to reduce chaffing or uncomfortable rubbing of the elongated portions 300, 310, 320, 330 on the foot disposed within the article of footwear 10. In one embodiment, the panels 305, 306, 307, 316, 326 may be constructed from suede or other form of leather that is bonded to the interior surface of the first portion 140 of the upper 130. In another embodiment, the panels 305, 306, 307, 316, 326 may be constructed from a synthetic leather or other nonwoven product. The panels 305, 306, 307, 316, 326 may be secured to the inner surface of the first portion 140 of the upper 130 via any conventional means, including, but not limited to, bonding, adhesives, stitching, etc.

As previously explained, each of the eyelets 160 of the reconfigurable fastening system of the article of footwear 10 is formed by one of the elongate members 300, 310, 320, 330 and the exterior surface of the first portion 140 of the upper 130. More specifically, the configuration of each of the eyelets 160 includes a pair of slits 200 and a portion of one of the elongated members 300, 310, 320, 330 that is exposed or visible on an exterior of the upper 130 via the elongated members 300, 310, 320, 330 extending through the pairs of slits 200. The opening of each eyelet 160, as described herein, is formed or defined by the visible or exposed portion of one of the elongate members 300, 310, 320, 330 that is threaded or passed through a pair of slits 200 and the portion of the upper 130 that is disposed between each pair of slits 200. The opening of each eyelet 160 is configured to receive a fastener 170, where the fastener 170 is threaded or passed through the opening of the eyelet 160 (i.e., between the upper 130 and the exposed portion of the elongate member 300, 310, 320, 330). The opening of each eyelet 160 may be oriented transverse or orthogonal to the orientation of the pair of slits 200 that formulate the eyelet 160. Thus, for eyelets 160 formed with slits 200 in the first orientation 210, the openings of the eyelets 160 are oriented in a first or transverse direction (i.e., a fastener 170 passes through the opening of the eyelet 160 along the widthwise direction of the article of footwear 10). For eyelets 160 formed with slits 200 in the second orientation 220, the openings of the eyelets 160 are oriented in a second or lengthwise direction (i.e., a fastener 170 passes through the opening of the eyelet 160 along the lengthwise direction of the article of footwear 10).

With this configuration, a fastener 170 may be selectively threaded through any of the eyelets 160 on the medial and lateral sides 100, 102 of the article of footwear 10 to alter fit of the article of footwear 10 for a specific level of comfort and/or to provide a specific amount of support. The plurality of eyelets 160 disposed on both sides 100, 102 of the upper 130 enable the user of the article of footwear 10 to customize the tightness/stiffness of the article of footwear 10, the support provided by the article of footwear 10, and ultimately, the amount of comfort of the article of footwear 10. The more eyelets 160 through which the fastener 170 is threaded, the more support the article of footwear 10 is capable of providing. For example, if the fastener 170 were threaded through each of the eyelets 160 in the first and third rows 162(1), 162(3) of columns 164(1)-164(4) on both the medial and lateral sides 100, 102 of the article of footwear 10, the fastener 170 may be tightened such that the article of footwear 10 is tightly compressed pressed against a foot disposed within the article of footwear 10 and capable of providing support to the arch and instep of the foot. In another example, if the fastener 170 were threaded only through the eyelets 160 located in the first row 162(1) of columns 164(1), 164(3) on both the medial and lateral sides 100, 102 of the article of footwear 10, the article of footwear 10 could be fit looser around the foot disposed within the article of footwear 10, and may not be capable of providing as much support as the previously described example. In addition, the article of footwear 10 of the second example may be more comfortable for a user with a wider foot (enabling the medial and lateral quarters 136, 138 to spread farther apart from one another), while the article of footwear 10 of the first example may be more comfortable for a user with a thinner foot. Thus, the eyelets 160 of the reconfigurable fastening system of the article of footwear 10 enable the user to optimize the support and comfort levels of the article of footwear 10 by selectively threading the fastener 170 through chosen eyelets 160 disposed on the upper 130. The optimization may be based on footwear usage (e.g., more support for athletic activities, such as running; less support when wearing the article of footwear 10 for a prolonged period of time) and/or based on the shape of the foot disposed within the article of footwear 10 (e.g., less eyelets 160 utilized for wider feet; more eyelets 160 utilized for narrow feet). The manner and number in which the fastener 170 is threaded through the eyelets 160 enables the user to alter the topography of the upper 130 to properly fit the shape of the foot disposed within the article of footwear 10.

Figure 4A:
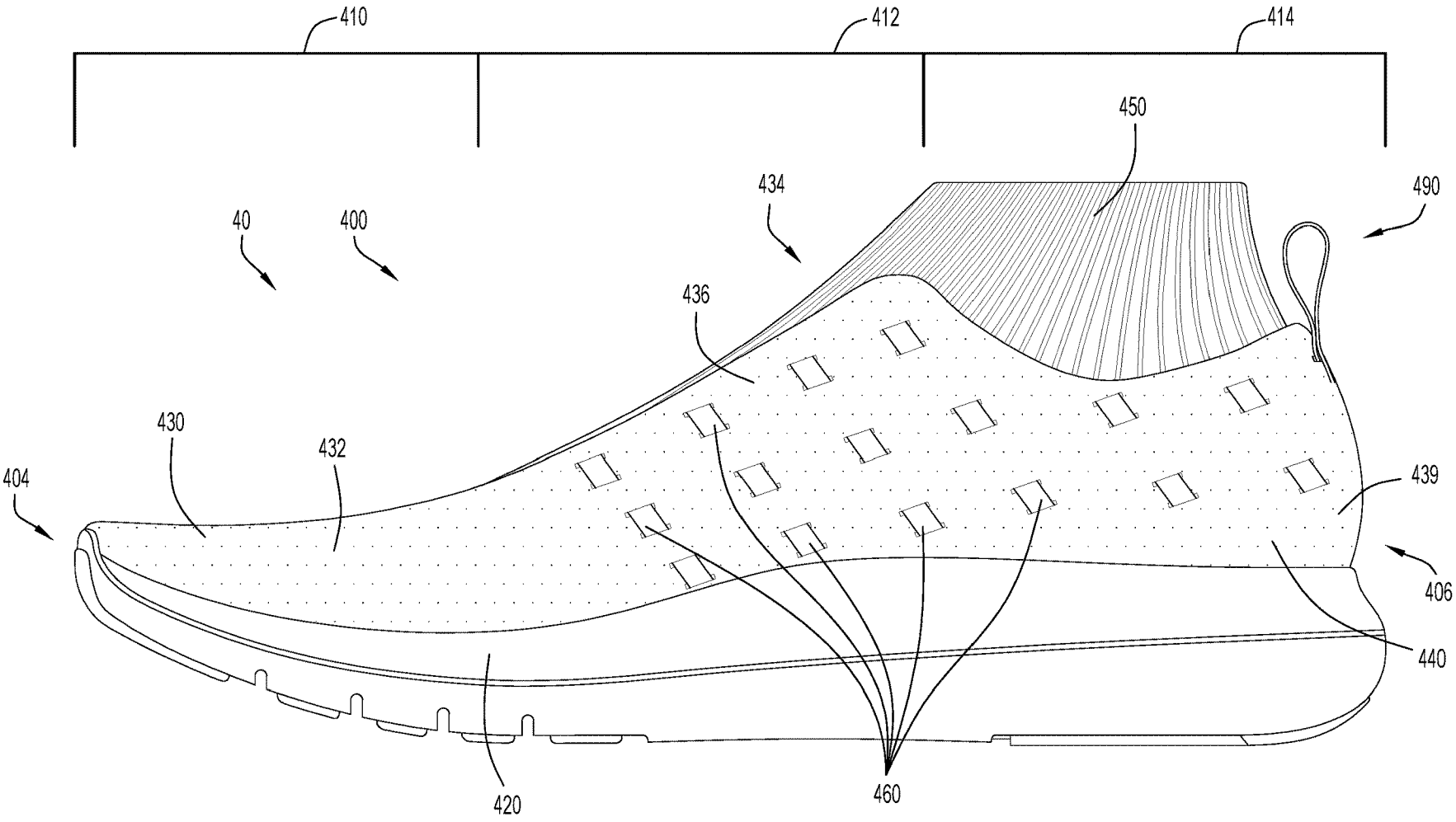
FIG. 4A illustrates a side view in elevation of the medial side of a second embodiment of an article of footwear in accordance with the present invention.
Figure 4B:
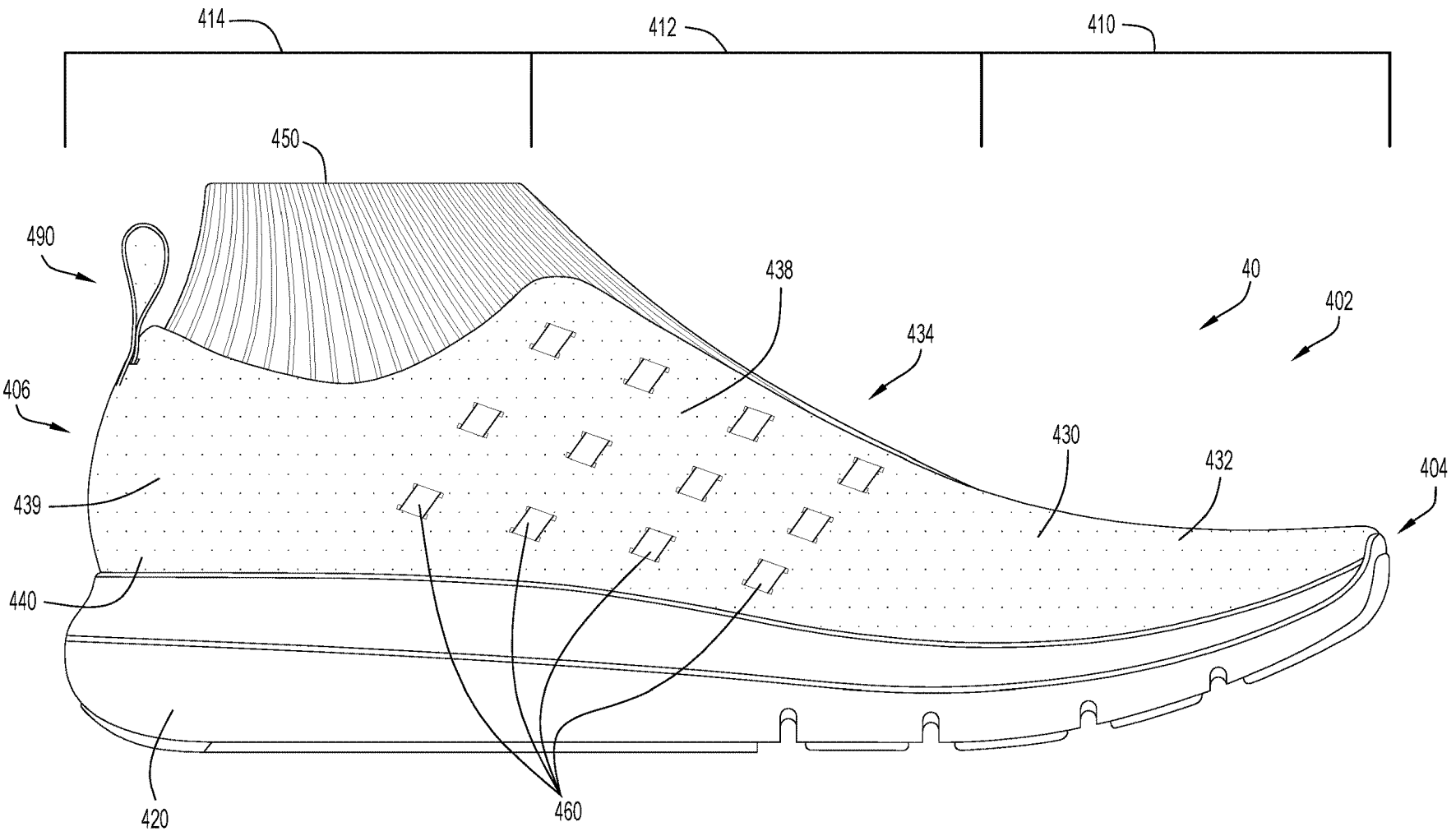
FIG. 4B illustrates a side view in elevation of the lateral side of the second embodiment of the article of footwear illustrated in FIG. 4A.
Figure 5:
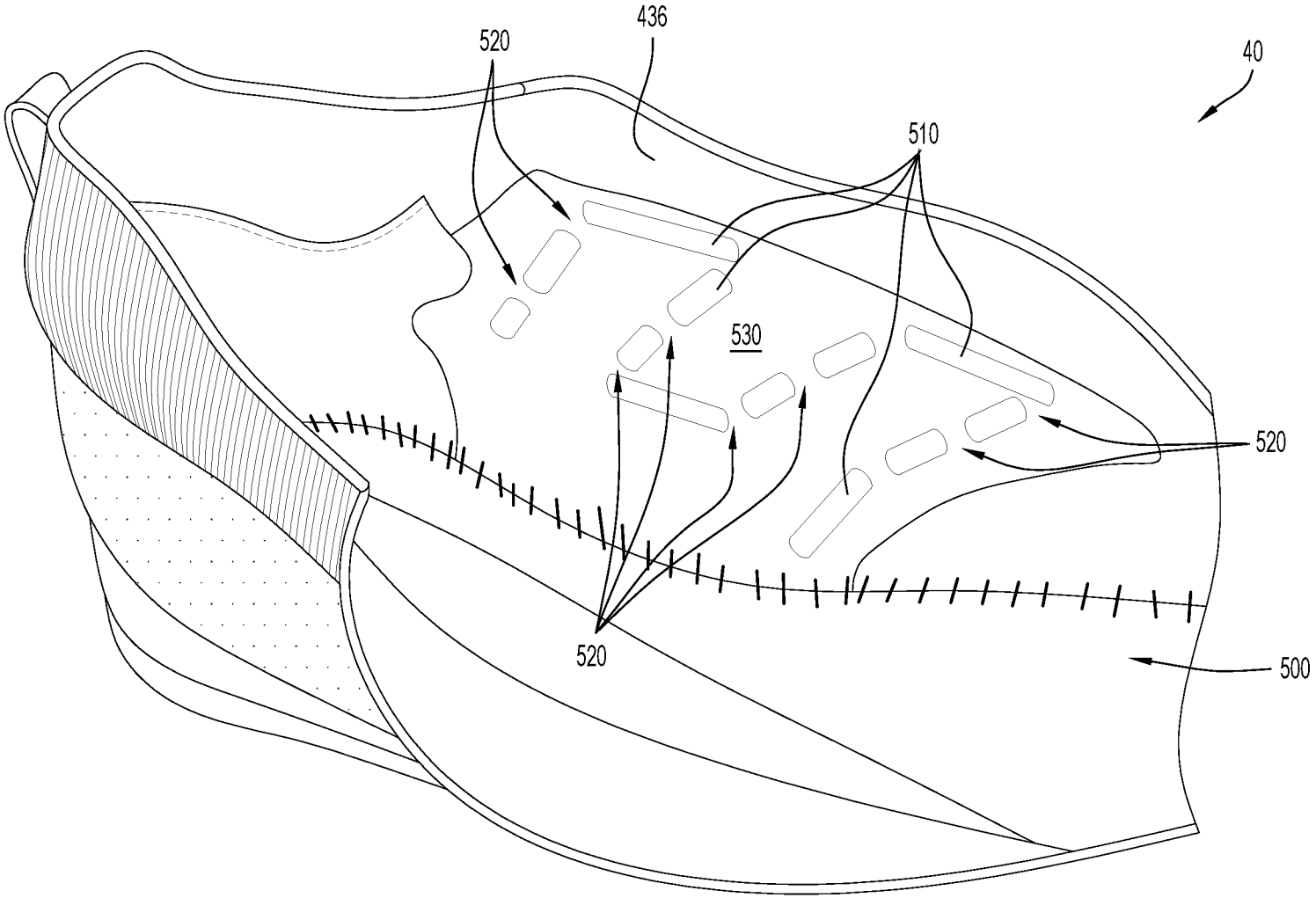
FIG. 5 illustrates an interior view of the medial side of the second embodiment of the article of footwear illustrated in FIG. 4A.

Illustrated in FIGS. 4A, 4B, and 5 is a second embodiment of an article of footwear or shoe 40 with a reconfigurable fastening system similar to that as previously described. This second embodiment 40 includes a medial side 400 oriented along the medial or big toe side of the user's foot, a lateral side 402 oriented along the lateral or little toe side of the user's foot, a toe (i.e., front) end 404 that corresponds with the toes of the user's foot, and a heel (i.e., rear) end 406 that corresponds with the heel of the user's foot. While the second embodiment 40 depicted in the FIGS. 4A, 4B, and 5 shows an article of footwear 40 configured for a right foot, it is noted that the same or similar features can also be provided for an article of footwear 40 configured for a left foot (where such features of the left footed article of footwear are a reflection of or "mirror image" symmetrical in relation to the right footed article of footwear, e.g., the embodiment depicted in FIGS. 4A, 4B, and 5).

Similar to the first embodiment of the article of footwear 10, the second embodiment 40 may include a forefoot region 410 that generally aligns with the ball and toes of a user's foot (i.e., when a user is wearing the article of footwear 40), a midfoot region 412 that generally aligns with the arch and instep areas of the user's foot, and a hindfoot region 414 that generally aligns with the heel and ankle areas of the user's foot. The second embodiment of the article of footwear 40 further includes a sole structure 420 and an upper 430 affixed to the sole structure 420. The upper 430 defines an envelope or pocket that covers and protects the foot of the wearer. In some embodiments, the upper 430 covers and protects the foot of the wearer together with the sole structure 420. The upper 430 includes a toe cage 432 disposed proximate to the front end 404 of the forefoot region 410 of the article of footwear 40. As further illustrated, the upper 430 also includes an instep 434, where the instep 434 is disposed rearward of the toe cage 432 within the midfoot region 412 of the article of footwear 40. The upper 430 may further include a heel cup 439 disposed in the hindfoot region 414 and around the heel end 406 of the article of footwear 40. In addition, similar to the first embodiment of the article of footwear 10, the upper 430 of the second embodiment 40 includes a medial quarter 436 that extends through the midfoot region 412 from the toe cage 432 to the heel cup 439 along the medial side 400, and a lateral quarter 438 that extends through the midfoot region 412 from the toe cage 432 to the heel cup 439 along the lateral side 402. The upper 430 may further include an exterior surface 490 (illustrated in FIGS. 4A and 4B) and an interior surface 500 (illustrated in FIG. 5).

Like the first embodiment of the article of footwear 10, the upper 430 of the second embodiment of the article of footwear 40 includes a first portion 440 and a second portion 450. As illustrated in FIGS. 4A and 4B, the first portion 440 may form a lower portion of the upper 430, while the second portion 450 may form an upper portion of the upper 430. The second portion 450 may further define an aperture 454 that provides access to the interior of the second embodiment of the article of footwear 40. As illustrated, both the first portion 440 and the second portion 450 may be formed or constructed from a knit material/fabric (e.g., flat knit, circular knit, etc.) or a woven material/fabric. This enables the upper 430 to be a more flexible, elastic, and/or breathable material than uppers constructed of conventional materials (e.g., leather, suede, plastics, etc.). This also enables the upper 430 of the second embodiment of the article of footwear 40 to be lighter than conventional footwear. While both the first and the second portions 440, 450 may be formed of knit/woven materials, the second portion 450 may be more resilient and elastic material than the first portion 440.

As illustrated in FIGS. 4A and 4B, a plurality of eyelets 460 are disposed on the first portion 440 of the upper 430, and more specifically, the medial and lateral quarters 436, 438 of the upper 430. Each of the plurality of eyelets 460 of the second embodiment of the article of footwear 40 is configured to receive a portion of a fastener (i.e., a fastener may be threaded through each of the plurality of eyelets 460). As illustrated in FIGS. 4A, and 4B, the plurality of eyelets 460 are disposed on the medial and lateral sides 400, 402 of the upper 430 in a grid-like array (i.e., in a series of rows and columns) like that of the eyelets 160 of the first embodiment of the article of footwear 10. Unlike the first embodiment of the article of footwear 10, the second embodiment 40 does not contain any eyelets 460 that are disposed across the instep 434 of the upper 430.

The plurality of eyelets 460 of the second embodiment 40 may be constructed in a similar manner as the eyelets 160 of the first embodiment 10, where each of the eyelets 460 is formed from a pair of slits disposed in the upper and an elongate member threaded through the slits such that an exposed portion of the elongate member is disposed on the exterior surface 490 of the upper 430. As best illustrated in FIG. 5, a single elongate member 510 is utilized to form the plurality of eyelets 460 on the medial side 400 of the second embodiment of the article of footwear 40, by threading the elongate member 510 through the pairs of slits on the medial side 400 in a square wave pattern. While not illustrated, a single elongate member is also utilized to form the plurality of eyelets 460 on the lateral side 402 of the second embodiment of the article of footwear 40 by threading the single elongate member through the pairs of slits on the lateral side 402 in a square wave pattern. Thus, only two elongate members are used to form the eyelets 460 of the second embodiment of the article of footwear 10.

The elongate member 510 is shown in FIG. 5 is disposed mainly on the interior surface 500 of the medial quarter 436. The elongate member 510 is illustrated as having gaps 520, which are the result of the elongate member 510 being threaded through the slits of the eyelets 460 to create the exposed portions of the elongate member 510 on the exterior surface 490 of the upper 430. A panel 530 may be disposed on the interior surface 500 of the medial quarter 436 and over the elongate member 510 to capture and secure portions of the elongate member 510 against the interior surface 500 of the medial quarter 136. The panel 530 may be constructed from any material (e.g., suede) that provides structure and rigidity to the medial quarter 436 of the upper 430 while also securing the elongate member 510 in place. Because the panel 530 covers the portions of the elongate member 510 disposed on the interior surface 500, the panel 530 may serve to make the interior surface 500 of the medial quarter 436 more comfortable (i.e., by smoothing the interior surface 500 and potentially eliminating or reducing any potential irritations caused by the portions of the elongate member 510 disposed on the interior surface 500). While the interior surface 500 of the lateral quarter 438 is not illustrated, the lateral quarter 438 may include an elongate member and panel that is substantially identical to that of the medial quarter 436.

A fastener may be threaded through one or more of the eyelets 460 on the medial side 400 of the article of footwear 40 and one or more of the eyelets 460 on the lateral side 402 of the article of footwear 40, where the fastener may be pulled to tighten the upper 130 around a foot disposed within the article of footwear 40. Unlike the eyelets 160 of the first embodiment of the article of footwear 10, the eyelets 460 of the second embodiment of the article of footwear 40 are all oriented in the same orientation (i.e., similar to the second orientation 220 of the eyelets 160 of the first embodiment of the article of footwear 10), where the openings (i.e., the space between the exposed portion of the elongate member 510 and the exterior surface 490 of the upper 430) of the eyelets 460 are oriented in a lengthwise direction (i.e., a fastener passes through the opening of the eyelet 460 along the lengthwise direction of the second embodiment article of footwear 40).

Like the first embodiment of the article footwear 10, the eyelets 460 of the reconfigurable fastening system of the second embodiment of the article of footwear 40 enable the user to optimize the support and comfort levels of the article of footwear 10 by selectively threading a fastener through a chosen set of eyelets 460 disposed on the upper 430. The optimization may be based on footwear usage (e.g., more support for athletic activities, such as running; less support when wearing the article of footwear 40 for a prolonged period of time) and/or based on the shape of the foot disposed within the article of footwear 40 (e.g., less eyelets 460 utilized for wider feet; more eyelets 460 utilized for narrow feet). Thus, the manner in which a fastener is threaded through the eyelets 460 enables a user to alter the topography of the upper 430 to properly fit the shape of the foot disposed within the article of footwear 40.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. An article of footwear comprising: a sole; an upper coupled to the sole, the upper being configured to receive at least a portion of a human foot, the upper including a medial quarter and a lateral quarter; and a plurality of eyelets disposed on the medial quarter and the lateral quarter, each eyelet including a pair of openings disposed in the upper, the plurality of eyelets further including at least one elongate member threaded through the pair of openings of each eyelet such that the elongate member includes a series of unexposed portions that are disposed on an inner surface of the upper and a series of exposed portions that are disposed on an outer surface of the upper, wherein each exposed portion of the elongate member enables a fastener to be threaded between the exposed portion and the outer surface of the upper;

wherein the plurality of eyelets are arranged in a series of columns and rows; wherein the series of columns and rows include at least four columns and at least three rows;

wherein the pair of openings of each eyelet in a first row and a third row in the at least three rows are slits that extend in a longitudinal direction of the article of footwear, and wherein the pair of openings of each eyelet in a second row of the at least three rows are slits that extend in a transverse direction of the article of footwear.

2. The article of footwear of claim 1, where the upper further includes a toe cage, an instep, and a heel cup.

3. The article of footwear of claim 2, wherein the plurality of eyelets are additionally disposed on the instep and the heel cup.

4. The article of footwear of claim 3, wherein the elongate member is a first elongate member disposed on the medial quarter in a sawtooth wave pattern, the plurality of eyelets further comprising:

a second elongate member disposed on the lateral quarter in a sawtooth wave pattern; and a third elongate member that extends from a medial side of the heel cup, through the medial quarter, over the instep, through the lateral quarter, and to a lateral side of the heel cup.

5. The article of footwear of claim 4, wherein the second elongate member includes a series of unexposed portions that are disposed on an inner surface of the upper and a series of exposed portions that are disposed on the outer surface of the upper, wherein each exposed portion of the second elongate member enables a fastener to be threaded between the second elongate member and the outer surface of the upper.

6. The article of footwear of claim 4, wherein the third elongate member includes a series of unexposed portions that are disposed on an inner surface of the upper and a series of exposed portions that are disposed on the outer surface of the upper, wherein each exposed portion of the third elongate member enables a fastener to be threaded between the third elongate member and the outer surface of the upper.

7. The article of footwear of claim 1, wherein the series of unexposed portions are portions of the elongate member that are disposed between each of the eyelets, and the series of exposed portions are portions of the elongate member that are disposed between the pair of openings of each eyelet.

8. An article of footwear comprising: a sole structure; and an upper coupled to the sole, the upper being configured to receive at least a portion of a human foot, the upper comprising: a medial quarter with a plurality of openings, a lateral quarter, and an elongate member threaded through the plurality of openings such that the elongate member includes a series of unexposed portions disposed on an interior surface of the medial quarter and a series of exposed portions disposed on an exterior surface of the medial quarter, wherein each exposed portion of the elongate member enables a fastener to be threaded between the exposed portion and the exterior surface of the medial quarter;

wherein the elongate member is a first elongate member, the plurality of openings of the medial quarter are a plurality of first openings, and further comprising: a plurality of second openings disposed in the lateral quarter; and a second elongate member threaded through the plurality of second openings such that the second elongate member includes a series of unexposed portions disposed on an interior surface of the lateral quarter and a series of exposed portions disposed on an exterior surface of the lateral quarter, wherein each exposed portion of the second elongate member enables the fastener to be threaded between the exposed portion of the second elongate member and the exterior surface of the lateral quarter;

wherein the plurality of first openings are disposed on the medial quarter in a series of rows and columns, and the plurality of second openings are disposed on the lateral quarter in a series of rows and columns;

wherein the series of rows of the plurality of first openings disposed on the medial quarter include at least four columns and at least three rows, and the series of rows of the plurality of second openings disposed on the lateral quarter include at least four columns and at least three rows; wherein both the plurality of first openings in a first row and a third row of the at least three rows on the medial quarter and the plurality of second openings in a first row and a third row of the at least three rows on the lateral quarter are slits that extend in a longitudinal direction of the article of footwear, and wherein both the plurality of first openings in a second row of the at least three rows on the medial quarter and the plurality of second openings in a second row of the at least three rows on the lateral quarter are slits that extend in a transverse direction of the article of footwear.

9. The article of footwear of claim 8, wherein the upper is constructed from a fabric material.

10. The article of footwear of claim 9, further comprising:

a first panel disposed on the interior surface of the medial quarter to secure the unexposed portions of the first elongate member against the interior surface of the medial quarter and to provide rigidity to the medial quarter.

11. The article of footwear of claim 10, further comprising:

a second panel disposed on the interior surface of the lateral quarter to secure the unexposed portions of the second elongate member against the interior surface of the lateral quarter and to provide rigidity to the lateral quarter.

12. An article of footwear comprising: a sole structure; and an upper disposed on the sole structure, the upper comprising: a medial side, a lateral side, a plurality of openings disposed on the medial side and the lateral side in an array, and an elongate member threaded through the plurality of openings such that the elongate member includes a series of unexposed portions disposed on an interior surface of the upper, and a series of exposed portions disposed on an exterior surface of the upper, wherein each exposed portion of the elongate member enables a fastener to be threaded between the exposed portion and the exterior surface of the upper; wherein the elongate member is a first elongate member, the plurality of openings of the medial quarter are a plurality of first openings, and further comprising: a plurality of second openings disposed in the lateral quarter; and a second elongate member threaded through the plurality of second openings such that the second elongate member includes a series of unexposed portions disposed on an interior surface of the lateral quarter and a series of exposed portions disposed on an exterior surface of the lateral quarter, wherein each exposed portion of the second elongate member enables the fastener to be threaded between the exposed portion of the second elongate member and the exterior surface of the lateral quarter;

wherein the elongate member is a first elongate member, the plurality of openings of the medial quarter are a plurality of first openings, and further comprising: a plurality of second openings disposed in the lateral quarter; and a second elongate member threaded through the plurality of second openings such that the second elongate member includes a series of unexposed portions disposed on an interior surface of the lateral quarter and a series of exposed portions disposed on an exterior surface of the lateral quarter, wherein each exposed portion of the second elongate member enables the fastener to be threaded between the exposed portion of the second elongate member and the exterior surface of the lateral quarter;

wherein the plurality of first openings are disposed on the medial quarter in a series of rows and columns, and the plurality of second openings are disposed on the lateral quarter in a series of rows and columns;

wherein the series of rows of the plurality of first openings disposed on the medial quarter include at least four columns and at least three rows, and the series of rows of the plurality of second openings disposed on the lateral Quarter include at least four columns and at least three rows; wherein both the plurality of first openings in a first row and a third row of the at least three rows on the medial quarter and the plurality of second openings in a first row and a third row of the at least three rows on the lateral quarter are slits that extend in a longitudinal direction of the article of footwear, and wherein both the plurality of first openings in a second row of the at least three rows on the medial quarter and the plurality of second openings in a second row of the at least three rows on the lateral quarter are slits that extend in a transverse direction of the article of footwear.

13. The article of footwear of claim 12, wherein the elongate member is a first elongate member threaded through the plurality of openings on the medial side of the article of footwear, and further comprising:

a second elongate member threaded through the plurality of openings on the lateral side of the article of footwear.

14. The article of footwear of claim 13, wherein the first elongate member is threaded through the plurality of openings on the medial side of the upper such that the first elongate member is in a square wave pattern.

15. The article of footwear of claim 14, wherein the second elongate member is threaded through the plurality of openings on the lateral side of the upper such that the second elongate member is in the square wave pattern.

16. The article of footwear of claim 13, wherein the upper is constructed from a fabric material.

17. The article of footwear of claim 16, further comprising:

a first panel disposed on the interior surface of the upper on the medial side of the upper to secure the unexposed portions of the first elongate member against the interior surface of the upper and to provide rigidity to the medial side of the upper; and a second panel disposed on the interior surface of the upper on the lateral side of the upper to secure the unexposed portions of the second elongate member against the interior surface of the upper and to provide rigidity to the lateral side of the upper.

* * * * *